US005701884A

United States Patent [19]

Fondas et al.

[11] Patent Number: 5,701,884

[45] Date of Patent: Dec. 30, 1997

[54] SNORKEL WITH STROBE LIGHT

[76] Inventors: Evangelos Fondas, Seafoam, West Bay Street, Cable Beach; Christopher Papageorge, Sandy Port, Clipper Island, Apt. A-1, West Bay Street, both of Nassau, Bahamas

[21] Appl. No.: 615,896

[22] Filed: Mar. 14, 1996

[51] Int. Cl.[6] ..... B63C 11/16

[52] U.S. Cl. ..... 128/201.11; 128/200.24; 128/200.29

[58] Field of Search ..... 128/201.11, 200.24, 128/200.29; 116/26, 209, DIG. 43

[56] References Cited

U.S. PATENT DOCUMENTS

| | | | |
|---|---|---|---|
| D. 339,400 | 9/1993 | Lin | D21/236 |
| 908,690 | 1/1909 | Neubert | 128/201.11 |
| 989,145 | 4/1911 | Hatchett | 116/26 X |
| 3,139,087 | 6/1964 | Liberatore | 128/201.11 |
| 3,433,222 | 3/1969 | Pinto | 128/201.24 |
| 4,611,551 | 9/1986 | Ferguson et al. | 114/339 |
| 5,343,825 | 9/1994 | Gazecimeon et al. | 116/173 |
| 5,402,774 | 4/1995 | Tiballi | 128/201.11 |

FOREIGN PATENT DOCUMENTS 24 44 712 9/1974 Germany .

*Primary Examiner*—Vincent Millin
*Assistant Examiner*—William J. Deane, Jr.
*Attorney, Agent, or Firm*—Robert C. Kain, Jr.

[57] ABSTRACT

The snorkel with a strobe light includes a strobe light mounted in a casing. A transparent cap covers the light at the top of the casing. A controllable strobe circuit also mounted in the casing. The strobe circuit includes a user actuatable switch and a battery which, in connection with the strobe circuit, electrically drives the strobe light to provide periodic illumination. The casing includes a coupler which provides an interference fit over an upper region of the snorkel. The strobe light unit is removably attached to the top end of the snorkel via the coupler.

19 Claims, 2 Drawing Sheets

SNORKEL WITH STROBE LIGHT

The present invention relates to a snorkel with a strobe light attached to the top thereof.

BACKGROUND OF THE INVENTION

U.S. Pat. No. 5,402,774 to Tiballi discloses a snorkel with a flag attached to the top end of the snorkel. U.S. Pat. No. 3,433,222 to Pinto discloses a diving helmet with a light attached to the top of the helmet. Design Pat. No. D 339,400 discloses a diving snorkel with a cage and valve device attached to the top of the snorkel.

OBJECTS OF THE INVENTION

It is an object of the present invention to provide a snorkel with a strobe light at its top.

It is an additional object of the present invention to provide a snorkel wherein the strobe light can be permanently mounted on or be attached or removed from the top end of the snorkel.

It is a further object of the present invention to have multiple colors and multiple lights in the strobe light unit for different types of emergencies which may be encountered by the diver using the snorkel.

It is a further object of the present invention to provide a snorkel with a strobe light which provides additional protection for the diver by warning others of the location of the diver.

SUMMARY OF THE INVENTION

The snorkel with a strobe light includes a strobe light mounted in a casing. A transparent cap covers the light at the top of the casing. A controllable strobe circuit also mounted in the casing. The strobe circuit includes a user actuatable switch and a battery which, in connection with the strobe circuit, electrically drives the strobe light to provide periodic illumination. The casing includes a coupler which provides an interference fit over an upper region of the snorkel. The strobe light unit is removably attached to the top end of the snorkel via the coupler. Alternatively, the strobe light unit is permanently attached to the top of the snorkel.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a snorkel with a strobe light.

Figures 1, 2:
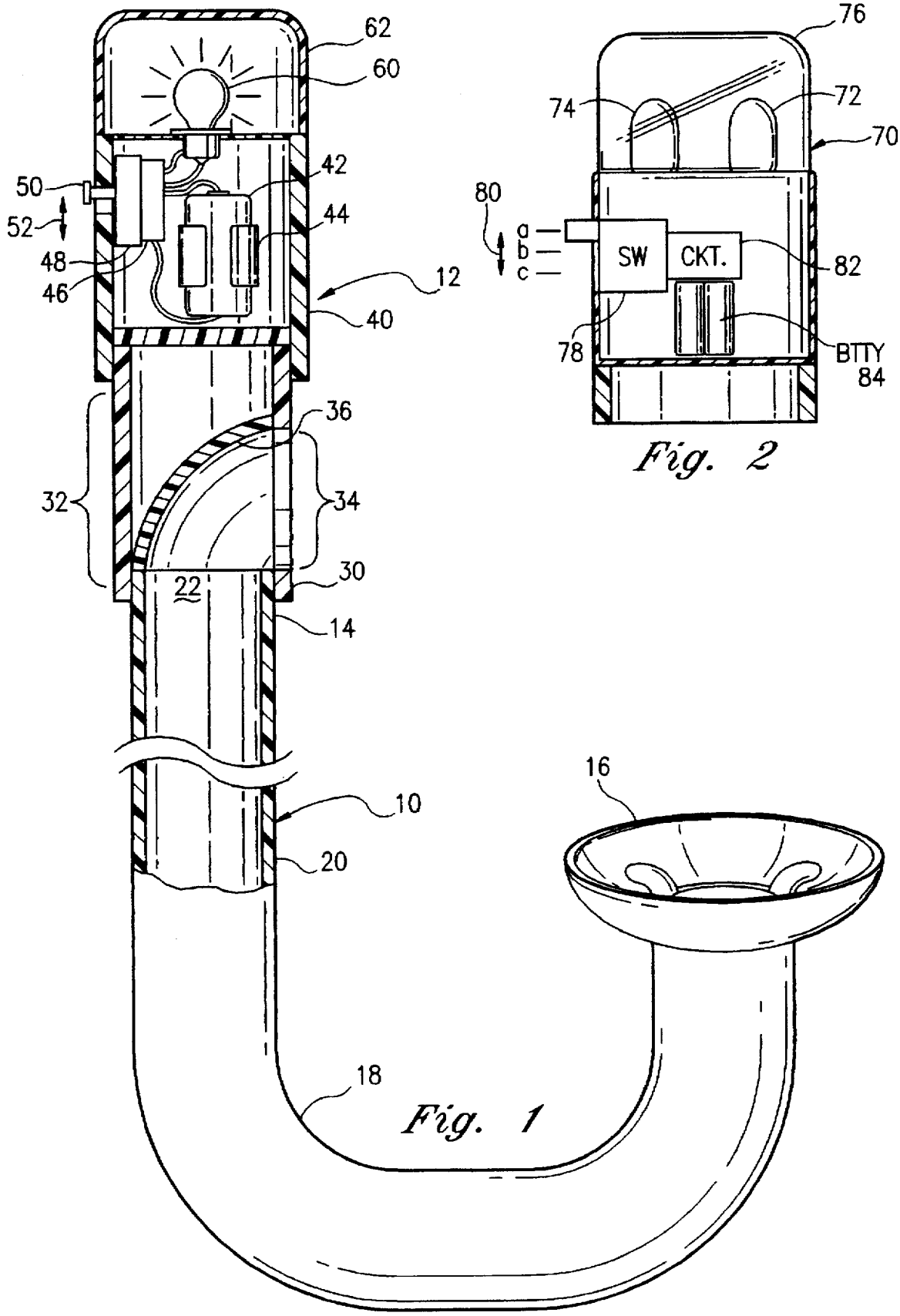
FIG. 1 diagrammatically illustrates a partial, cut-away view of a snorkel and the attached strobe light unit.
FIG. 2 diagrammatically illustrates the strobe light unit with two strobe lights.

FIG. 1 diagrammatically illustrates snorkel 10 with strobe light device 12 attached to a top region 14 of the snorkel. Conventional snorkels include mouthpiece 16, a generally U-shaped section 18, and elongated, main tubular section 20 leading up to a top region 14. Top region 14 has an open, tubular top 22. As is known in this field, divers place mouthpiece 16 in their mouths and inhale and exhaust air through the tubular snorkel via open tubular top 22 of the snorkel.

In a preferred embodiment, a strobe light unit 12 is attached to the top of a snorkel. The snorkel has an upper regional wall with an open side port 34. A diversion wall 36, inside the upright snorkel tube, diverts water and air during use of the snorkel. In another embodiment, the strobe light unit 12 is detachable.

Strobe light unit 12 includes, in one embodiment, a bottom coupler section 30 which fits around open tubular top 22 of the snorkel with an interference fit. Strobe light unit 12 includes a mid section region 32 having an open port hole 34 along one arcuate side region. Other portions of mid section 32 are closed such that intake and exhaust air passes from the top of the snorkel via open top 22 and into and out of side port hole 34. In order to easily eject water which may become trapped in snorkel 10, the strobe light unit 12 includes a diversion wall 36 positioned at an angle within the interior of coupler mid section 32. The diversion wall assists in the ejection of water from the snorkel and the exhaust of air. In use, side port 34 is above water level due to elongated snorkel region 20.

Strobe light unit 12 also includes a strobe light casing 40. Disposed within strobe light casing 40 is a battery 42 retained by clips 44 (or other retaining mechanisms), an electronic strobe circuit 46 and switch body 48. A user actuated switch lever 50 extends beyond strobe light casing 40. The user moves switch 50 in the direction shown by arrow 52 thereby turning ON or OFF strobe light 60. Strobe light 60 is sealed by transparent cap 62. Various electrical connections are shown only to illustrate the common connections and electrical couplings between battery 42, strobe circuit 46, switch 48 and strobe light 60.

In use, the diver can turn ON and OFF the strobe light by manually moving switch 50 in the direction shown by double-headed arrow 52. When in use, strobe light 60 periodically emits light thereby notifying anyone in the vicinity of the diver of the diver's location. This can be helpful in order to ensure the safety of the diver and avoid collision with boats, rafts, etc. Also, in an emergency situation, strobe light 60 can be activated simply by moving switch 48 to an ON position.

The strobe light unit 12 can be removably attached or detached from the upper region 14 of snorkel 10. This is accomplished by the interference fit between the lower end 30 of the coupler and the upper end 14 of snorkel 10. The light and the electronics are sealed in the casing. A watertight seal is suggested. It may be necessary to seal the switch lever from the water or to use a push-button type switch.

In a preferred embodiment, strobe light unit 12 is permanently attached to the top of the snorkel. In this embodiment, upper regional wall 14 of snorkel 10 forms lower regional wall 32 of unit 14. Diversion wall 36 diverts air and water from snorkel top 14 through open side port 34. To replace the battery or strobe lamp 60, a watertight screw fitting between casing 40 and regional wall 32 may be appropriate.

FIG. 2 diagrammatically illustrates another configuration for strobe light unit 70. In this configuration, a white strobe light 72 is mounted adjacent a red strobe light 74. Both strobe lights are sealed within a transparent cap 76. Switch 78 is a three position switch which can be moved in the direction as shown by the double-headed arrow 80. As an example, switch position a could be the OFF position, switch position b could be the white strobe light ON and switch position c could be the red strobe light ON position. Strobe circuit 82 is utilized to electrically power and drive strobe lights 72 and 74. A pair of batteries 84 is shown in connection with strobe light unit 70. The strobe circuit may alternatively illuminate the strobe lights in a RED-WHITE-RED sequence.

Figure 3:
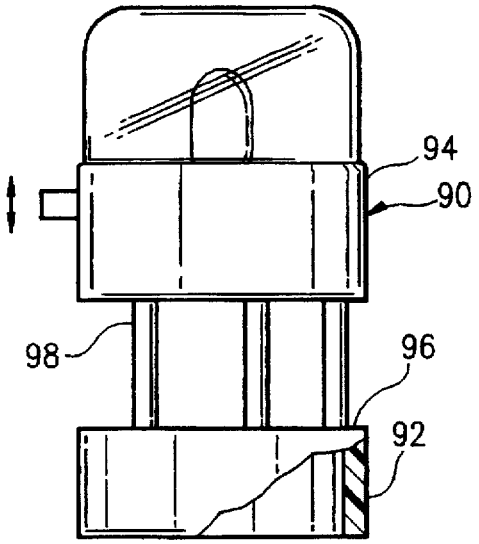
FIG. 3 diagrammatically illustrates another configuration for the strobe light unit using a basket intake and exhaust system.

FIG. 3 diagrammatically illustrates a further embodiment of strobe light unit 90. In this embodiment, the coupler has a lower section 92 which attaches to upper end 14 of snorkel 10 with an interference fit. Strobe light casing 94 is spaced away from the open, upper end 96 of coupler 92 via support elements, one of which is support element 98. In general, support element 98 and the other support elements form a "basket" or cage which permits the intake and exhaust of air through the snorkel and coupler 92. The air is exhausted over 360° around the snorkel. The remaining components of strobe light unit 90 are similar to the components discussed above in connection with FIGS. 1 and 2.

Figure 4:
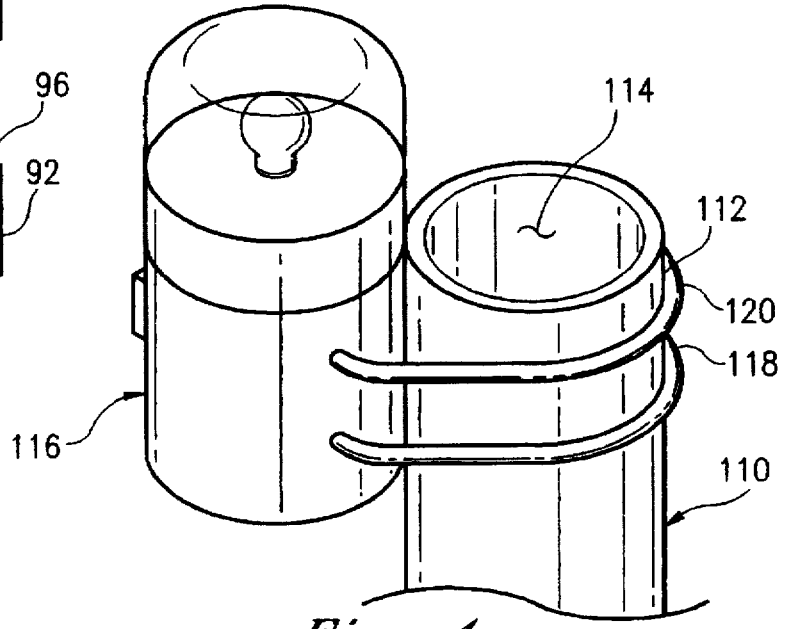
FIG. 4 diagrammatically illustrates the strobe light unit strapped to the top of the snorkel.

FIG. 4 illustrates that snorkel 110 has a top region 112 and a tubular, open top 114. Strobe light unit 116 is mounted in an offset position and is attached to top region 112 of snorkel 110 by a pair of straps 118 and 120. These straps may be elastic rings or other type of straps which mount strobe unit 116 onto the top region 112 of snorkel 110. Rings 118 and 120 form an interference fit and are part of the coupling mechanism for strobe light unit 116.

Figure 5:
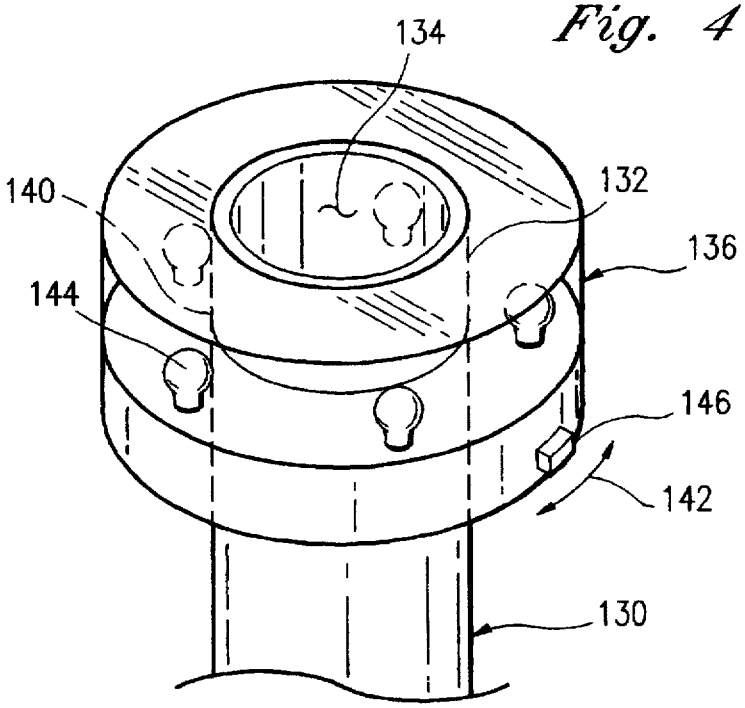
FIG. 5 diagrammatically illustrates the strobe light unit as a ring.

FIG. 5 diagrammatically illustrates snorkel 130 having a top region 132 and an open tubular top 134. The strobe light unit 136 is formed as a ring which is attached to top region 132 of snorkel 130 by an interference fit. This interference fit is provided by a radially inward retaining wall 140 of the ring. The ring may have an inward lip (not shown) which mates with the top of the snorkel. In the embodiment illustrated in FIG. 5, a plurality of strobe lights, one of which is strobe light 144, are circumferentially disposed about the strobe light unit 136. Switch 146 can be moved by the diver in direction shown by double-headed arrows 142.

The claims appended hereto are meant to cover modifications and changes within the spirit and scope of the present invention.

What is claimed is:

1. A snorkel with a strobe light comprising:

a snorkel having a generally U-shaped mouthpiece portion leading directly to a rigid, elongated tubular body portion and an open, tubular top region, said tubular top region adapted to be raised above water level to permit an intake and exhaust of air from a diver;

a strobe light mounted in a casing;

a controllable strobe circuit electrically coupled to said strobe light and mounted within said casing, said strobe circuit including a battery and a user actuatable switch, said strobe circuit electrically driving said strobe light to provide periodic illumination;

said casing mounted on an upper region of said tubular, rigid body portion of said snorkel about said tubular top, whereby said casing, strobe light and strobe circuit are mounted onto the top of said snorkel.

2. A snorkel with a strobe light as claimed in claim 1 including an open portal along one arcuate side region of said tubular top region of said snorkel and a diversion wall angularly disposed inside said tubular top region of said snorkel at said portal such that intake and exhaust air from said diver is diverted through said side portal.

3. A snorkel with a strobe light as claimed in claim 2 including basket-like support elements extending above and beyond and spanning said tubular top region of said snorkel, said basket-like support elements supporting said casing and the enclosed strobe light and strobe circuit above and beyond said tubular top region of said snorkel, said basket defining an open midsection permitting the intake and exhaust of air in a 360 degree radius about said tubular top region of said snorkel.

4. A snorkel with a strobe light comprising:

a snorkel having a generally U-shaped mouthpiece portion leading directly to a rigid, elongated tubular body portion and an open, tubular top, said open, tubular top adapted to permit an intake and exhaust of air from a diver;

a strobe light mounted in a casing;

a controllable strobe circuit electrically coupled to said strobe light and mounted within said casing, said strobe circuit including a battery and a user actuatable switch, said strobe circuit electrically driving said strobe light to provide periodic illumination;

said casing having a coupler providing an interference fit over an upper region of said snorkel about said open, tubular top, said coupler mounting said casing, strobe light and strobe circuit onto the top of said snorkel above said rigid, elongated tubular body portion.

5. A snorkel with a strobe light as claimed in claim 4 wherein said coupler includes a tubular member having an open, bottom region adapted to closely fit over said open tubular top of said snorkel.

6. A snorkel with a strobe light as claimed in claim 5 wherein said coupler includes a tubular midsection defining an open portal along one arcuate side region of said midsection and a diversion wall closing said midsection and angularly disposed in said midsection with one end of said diversion wall adjacent said open portal at said one arcuate side region such that intake and exhaust air from said diver is diverted to and from said side portal from said open bottom region of said coupler.

7. A snorkel with a strobe light as claimed in claim 5 wherein said coupler includes a radially open midsection having support elements spanning said radially open midsection, said support elements having upper ends which are mounted to said casing and the enclosed strobe light and strobe circuit, said support elements supporting said casing, said light and said strobe circuit above and beyond said rigid, tubular elongated body portion of said snorkel, said open midsection permitting the intake and exhaust of air in a 360 degree radius about said open tubular top of said snorkel.

8. A snorkel with a strobe light as claimed in claim 4 wherein said coupler includes an offset mount which wraps around an upper region of said snorkel adjacent said open, tubular top such that said casing, said strobe light and said strobe circuit are mounted at an offset position with respect to said open tubular top and said rigid, elongated, tubular body portion of said snorkel.

9. A snorkel with a strobe light as claimed in claim 4 wherein said casing forms a ring and said coupler is defined by a radially inward retaining wall of said casing, said radially inward wall providing an interference fit with said upper region of said open tubular top of said snorkel.

10. A snorkel with a strobe light as claimed in claim 9 wherein said strobe light is a plurality of lights distributed circumferentially about said ring-shaped casing.

11. A snorkel with a strobe light as claimed in claim 4 wherein said strobe light is a first strobe light and emits a white light when illuminated, said casing carrying a second strobe light therein, said second strobe light emits a red light when illuminated, said controllable strobe circuit including a user actuatable switch having three positions for controlling said strobe circuit to actuate said first and said second strobe lights and place said strobe lights in an OFF condition.

12. A snorkel with a strobe light comprising:

a snorkel having an open, tubular top adapted to permit an intake and exhaust of air from a diver;

a first and second strobe light mounted in a casing, said first strobe light emitting a white light when illuminated and said second strobe light emitting a colored, non-white light when illuminated;

a controllable strobe circuit electrically coupled to said first and second strobe light and mounted within said casing, said strobe circuit including a battery and a user actuatable switch to actuate said first and second strobe light, said strobe circuit electrically driving said first and second strobe light to provide periodic illumination;

said casing mounted on an upper region of said snorkel about said open, tubular top, and said casing mounting said strobe light and strobe circuit onto the top of said snorkel.

13. A snorkel with a strobe light as claimed in claim 12 wherein said coupler includes a tubular member having an open, bottom region adapted to closely fit over said open tubular top of said snorkel.

14. A snorkel with a strobe light as claimed in claim 13 wherein said coupler includes a tubular midsection defining an open portal along one arcuate side region of said midsection and a diversion wall angularly disposed in said midsection such that intake and exhaust air from said diver is diverted to and from said side portal from said open bottom region of said coupler.

15. A snorkel with a strobe light as claimed in claim 13 wherein said coupler includes an open midsection having support elements spanning said open midsection, said support elements having upper ends which are mounted to said casing and the enclosed strobe light and strobe circuit, said open midsection permitting the intake and exhaust of air in a 360 degree radius about said open tubular top of said snorkel.

16. A snorkel with a strobe light as claimed in claim 12 wherein said coupler includes an offset mount which wraps around an upper region of said snorkel adjacent said open, tubular top such that said casing is mounted at an offset position with respect to said open tubular top of said snorkel.

17. A snorkel with a strobe light as claimed in claim 12 wherein said casing forms a ring and said coupler is defined by a radially inward retaining wall of said casing, said radially inward wall providing an interference fit with said upper region of said open tubular top of said snorkel.

18. A snorkel with a strobe light as claimed in claim 17 wherein said strobe light is a plurality of lights distributed circumferentially about said ring-shaped casing.

19. A snorkel with a strobe light as claimed in claim 12 wherein said user actuatable switch has three positions for controlling said strobe circuit to actuate said first and said second strobe lights and place said strobe lights in an OFF condition.

* * * * *